US012240582B2

(12) United States Patent
Creppel

(10) Patent No.: US 12,240,582 B2
(45) Date of Patent: Mar. 4, 2025

(54) STEERING MECHANISM FOR SHALLOW DRAFT CONTAINER CARRIER AND INLAND WATERWAY CONTAINER TRANSPORT VESSEL

(71) Applicant: Gregg George Creppel, New Orleans, LA (US)

(72) Inventor: Gregg George Creppel, New Orleans, LA (US)

( * ) Notice: Subject to any disclaimer, the term of this patent is extended or adjusted under 35 U.S.C. 154(b) by 405 days.

(21) Appl. No.: 17/608,349

(22) PCT Filed: May 1, 2020

(86) PCT No.: PCT/US2020/030919
§ 371 (c)(1),
(2) Date: Nov. 2, 2021

(87) PCT Pub. No.: WO2020/227046
PCT Pub. Date: Nov. 12, 2020

(65) Prior Publication Data

US 2022/0204150 A1 Jun. 30, 2022

Related U.S. Application Data

(60) Provisional application No. 62/843,214, filed on May 3, 2019.

(51) Int. Cl.
*B63H 25/42* (2006.01)
*B63H 5/16* (2006.01)

(52) U.S. Cl.
CPC ..... *B63H 25/42* (2013.01); *B63H 5/16* (2013.01); *B63H 2025/425* (2013.01)

(58) Field of Classification Search
CPC .. B63H 5/125; B63H 2005/1254; B63H 5/16; B63H 25/00; B63H 25/02; B63H 25/42;
(Continued)

(56) References Cited

U.S. PATENT DOCUMENTS 1,508,473 A 9/1924 Polis
1,900,711 A 3/1933 Howard
(Continued)

FOREIGN PATENT DOCUMENTS

CN 101100221 A 1/2008
CN 102745321 A 10/2012
(Continued)

OTHER PUBLICATIONS

Intellectual Property India, First Examination Report issued Jun. 8, 2023 which pertains to Indian Patent Application No. 202117056048. 6 pages.
(Continued)

*Primary Examiner* — Daniel V Venne
(74) *Attorney, Agent, or Firm* — Thompson Hine LLP

(57) ABSTRACT

A steering mechanism for a container carrier ship hull including a bow, a stern, and a container bay therebetween. The bow is provided with a set of depending lateral thruster pods, the set including a first pod disposed along a longitudinal centerline of the hull, a second pod disposed rearward of the first pod and outward from the centerline, and a third pod disposed rearward of the first pod and outward from the centerline opposite from the second pod. The first and second pods define a first longitudinal flow channel to one side of the centerline and the first and third thruster pods define a second longitudinal flow channel to the opposite side of the centerline. A fourth pod, which may omit thruster mechanisms, may be disposed along the centerline reward of the first, second, and third pods, to define with them first and second cross-centerline flow channels.

9 Claims, 7 Drawing Sheets

(58) Field of Classification Search
CPC ..... B63H 25/46; B63H 2025/425; B63H 2025/005; B63H 2025/465; B63B 1/042; B63B 25/004; B63B 2035/002
USPC ..... 114/49, 56.1, 60, 72, 144 B, 150, 151; 440/38, 39, 40, 67
See application file for complete search history.

(56) References Cited

U.S. PATENT DOCUMENTS

| | | | | |
|---|---|---|---|---|
| 1,933,860 | A | 11/1933 | Kjekstad | |
| 2,743,694 | A | 5/1956 | McAlcer | |
| 3,934,531 | A | 1/1976 | Allen | |
| 4,398,490 | A | 8/1983 | Cutts | |
| 4,719,871 | A | 1/1988 | Fantacci | |
| 4,843,989 | A | 7/1989 | Langenberg | |
| 5,937,777 | A | 8/1999 | Azima | |
| 6,386,131 | B1 | 5/2002 | Barsoum | |
| 6,439,936 | B1 | 8/2002 | Dreith et al. | |
| 6,516,737 | B2 * | 2/2003 | Le Coz | B63B 25/004 114/72 |
| 7,984,684 | B2 * | 7/2011 | Hinderks | B63H 21/14 114/274 |
| 8,187,046 | B2 | 5/2012 | Rolla | |
| 11,001,350 | B2 | 5/2021 | Creppel | |
| 2003/0145774 | A1 | 8/2003 | Coates et al. | |
| 2006/0137585 | A1 | 6/2006 | Levander et al. | |
| 2012/0100764 | A1 | 4/2012 | Wingate | |
| 2016/0208476 | A1 | 7/2016 | Wadley et al. | |
| 2017/0101167 | A1 | 4/2017 | Howard | |

FOREIGN PATENT DOCUMENTS

| | | | |
|---|---|---|---|
| CN | 103381877 | A | 11/2013 |
| CN | 107074338 | A | 8/2017 |
| EP | 0328499 | A1 | 8/1989 |
| JP | 2011031858 | A | 2/2011 |
| RU | 40288 | | 9/2004 |
| RU | 2446074 | | 3/2012 |
| RU | 2583328 | | 5/2016 |
| RU | 2700800 | | 9/2019 |
| WO | 2018/081574 | A1 | 5/2018 |

OTHER PUBLICATIONS

European Patent Office, Extended European Search Report issued May 10, 2023 which pertains to EP Patent Application No. 20802401.8. 10 pages.

Russian Federal Service for Intellectual Property, Decision to Grant issued May 26, 2023 which pertains to RU Patent Application No. 2021135645/11(075215). 22 pages.

(PCT) U.S. Patent and Trademark Office (ISA/US), International Search Report and Written Opinion of the International Searching Authority, International Application No. PCT/US2020/030919, 8 pages, Jul. 14, 2020.

(PCT) U.S. Patent and Trademark Office (ISA/US), International Search Report and the Written Opinion of the International Searching Authority, International Application No. PCT/US2017/058781, 7 pages, Jan. 5, 2018.

(US) U.S. Patent and Trademark Office, U.S. Appl. No. 16/345,253, Non-Final Office Action, 12 pages, May 14, 2020.

(US) U.S. Patent and Trademark Office, U.S. Appl. No. 16/345,253, Notice of Allowance, 8 pages, Jan. 13, 2021.

Brazilian Patent and Trademark Office, Preliminary Office Action issued Jul. 2, 2024, [includes English Translation], which pertains to Brazilian Patent Application No. BR1120210219021. 7 pages.

China National Intellectual Property Administration, Notification of Second Office Action (with partial translation), Chinese Patent Application No. 202080048976.X, 13 pp. Oct. 1, 2024.

* cited by examiner

STEERING MECHANISM FOR SHALLOW DRAFT CONTAINER CARRIER AND INLAND WATERWAY CONTAINER TRANSPORT VESSEL

TECHNICAL FIELD

The present disclosure relates generally to an intermodal cargo container carrier for transport along inland waterways, and more particularly to a steering mechanism for conducting limited-radius or zero-radius turning maneuvers in a riverine, shallow draft container carrier.

BACKGROUND

Container carriers, which may also be referred to as container ships or container transport vessels, are cargo ships that carry their load using standardized containers. The approach of carrying cargo within a standardized container may be referred to as containerization. Containerization is a system of intermodal cargo transport using standardized containers that may be accommodated by container carriers, railroad cars, and trucks. The capacity of a container carrier may be measured in twenty-foot equivalent units (TEU). It is to be appreciated that container carriers are a popular mode for transporting non-bulk cargo. In fact, a majority of non-bulk cargo is transported by container carriers.

Some factors that may hinder the travel of a vessel such as a container carrier along inland waterways include, but are not limited to, shoals and sand bars, low water stand, ice flow, and sections of high sinuosity. Each of these present or exacerbate a challenge to movement at speed for vessels that have restricted maneuverability. For example, although the main channel of the mouth of the Mississippi River is presently maintained to be about 45 feet deep and 500 feet wide, it should be appreciated that in the Mississippi River above Baton Rouge the main channel shallows and narrows considerably. The controlling depth of the entire Mississippi River inland waterway system is 12 feet, and the latter depth becomes particularly critical during periods of low water runoff such as, for example, the annual seasonal variation in water runoff during late summer and early fall, or during a drought, at which times the Army Corp of Engineers has a mandate to maintain the main channel at that controlling depth. Low water levels, natural and manmade obstacles, and shoaling within even the main channel may restrict navigable channel widths to substantially less than 200 feet.

Vessels operating in reaches of the Mississippi River basin north of Baton Rouge, especially during low water runoff periods, may have to operate in close proximity to opposing traffic and to maneuver around near-channel and in-channel obstacles. However, legacy barge and tow assets do not have maneuverability at speed, since they are typically powered purely at the stern of the tow with a so-called "pusher craft," and must either take advantage of or overcome the effects of river currents against the bow of the tow in order to conduct turning maneuvers. Such maneuvers can require making wide excursions across a navigable channel while slowing the vessel to facilitate a turning contribution by the current or simply to yield to opposing riverine traffic. Thus, there is a need for a steering mechanism for shallow draft vessels such as container carriers and transport vessels that provides enhanced maneuverability for navigating shallow waterways at speed.

DETAILED DESCRIPTION

Figure 1:
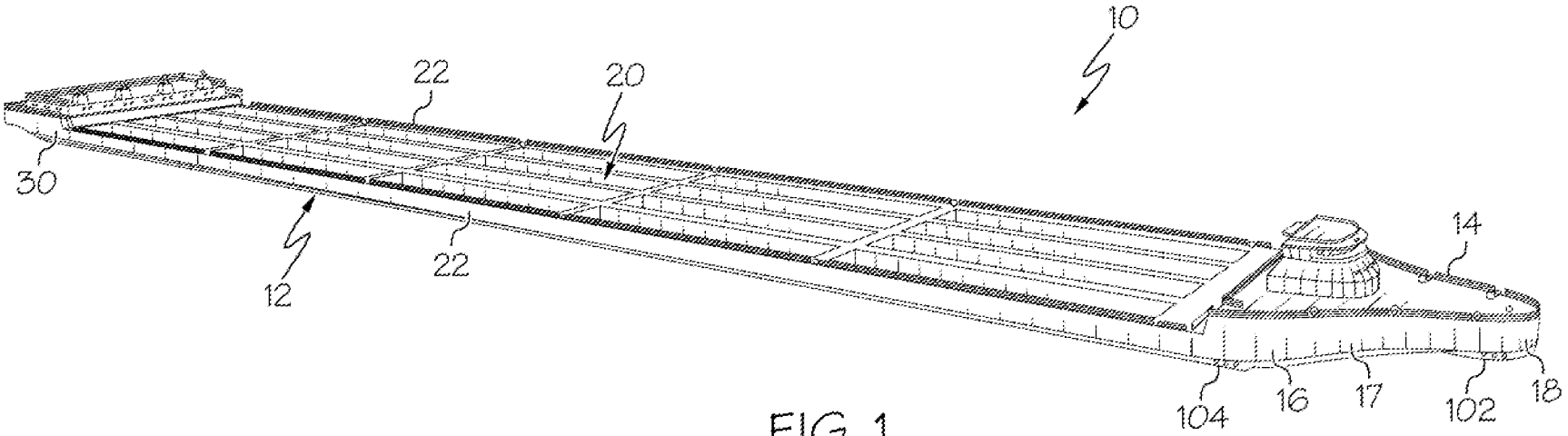
FIG. 1 is an elevated front perspective view of an exemplary container carrier.
Figure 2:
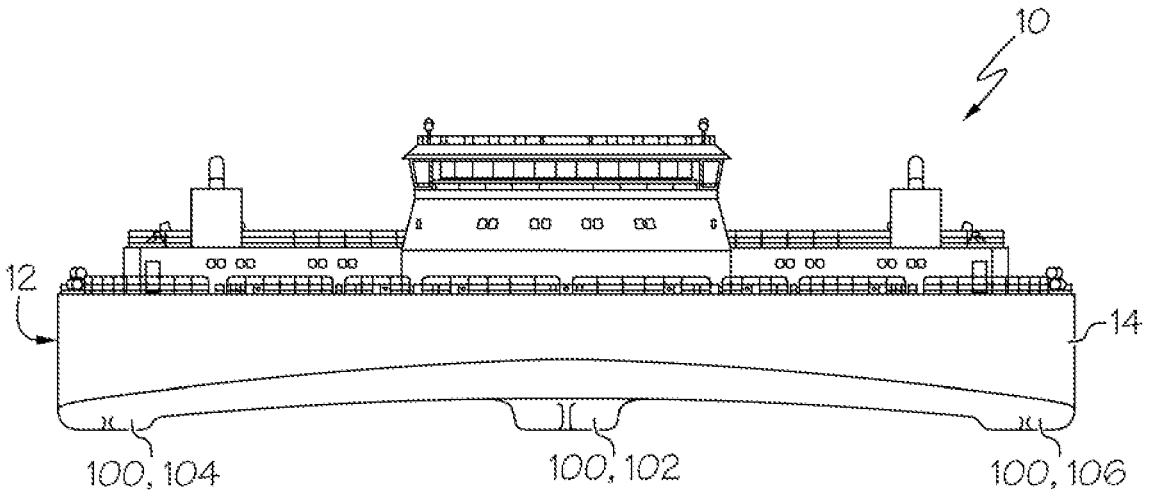
FIG. 2 is a front view of the container carrier of FIG. 1.

The following detailed description will illustrate the general principles of the mechanism, examples of which are additionally illustrated in the accompanying drawings. In the drawings, identical reference numbers indicate identical or functionally similar elements.

Figure 7:
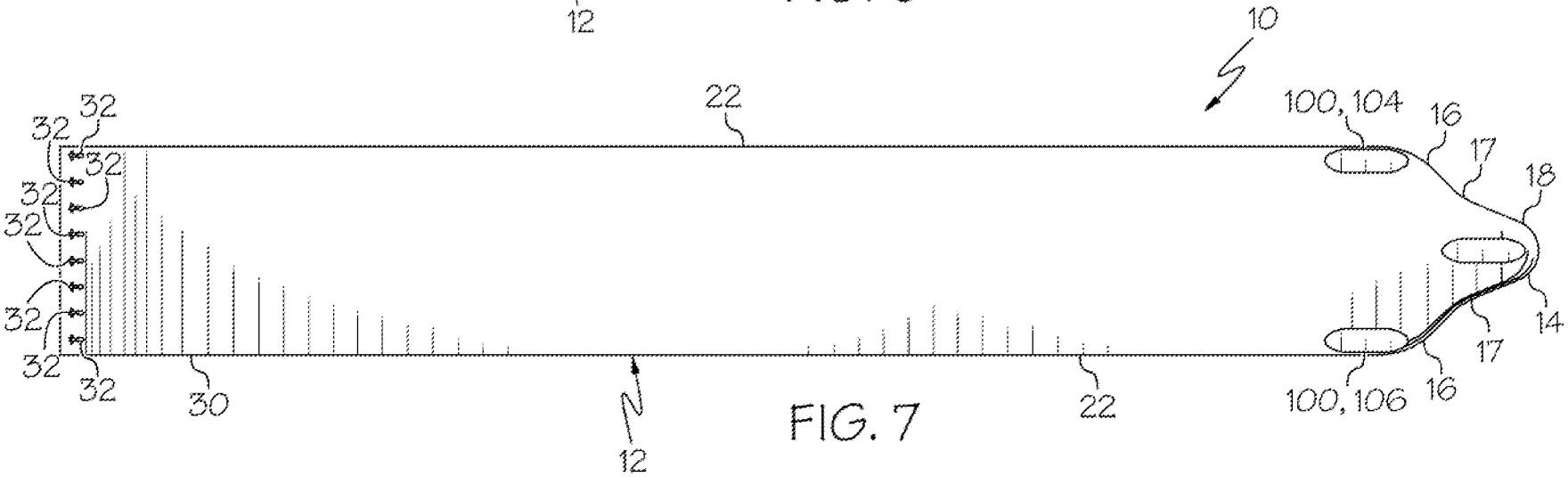
FIG. 7 is a bottom view of the container carrier of FIG. 1.

FIGS. 1-7 generally illustrate an exemplary container carrier 10. Referring specifically to FIG. 1, the container carrier 10 may include an external hull 12 having a bow 14. As best seen in FIGS. 1 and 7, the illustrated bow 14 includes a double radius ogive profile. That is, the bow 14 includes two sides that each include a rounded profile 16 having a first radius, a tapered end or ogive portion 18 having a second radius, and a recurved portion 17 disposed proximate the intersection of the rounded profile 16 with the end or ogive portion 18 to provide a smooth transition therebetween. In one embodiment, the double radius ogive bow may define two intersecting radii of about one hundred feet to produce a bow having a length of two hundred feet and a beam of two hundred feet, thereby approximating an equilateral triangle. Those of ordinary skill in the art will readily appreciate that an equilateral triangle is a generally strong and stable structure. As explained in greater detail below, the double radius ogive bow 14 may provide various technical effects and benefits, however other bow profiles including blunt and single radius ogive profiles may be used. The bow 14 may be connected to the stern 30 of the external hull 12 by a container bay 20 having mutually opposing lateral sides 22. Such a Shallow Draft Container Carrier or "SDCC" may embody dimensions between 700 feet to 1750 feet in length, and 100 feet to 250 feet in beam. In illustrated exemplary embodiment, the container carrier 10 may include an overall length L of 1,500 feet and may be 200 feet in beam. In one embodiment, the container carrier 10 may operate with a water draft of about twelve feet (+/−10%), and an air draft of about 50 feet (+/−10%), thereby allowing for year-round navigation and transport operation on waterways as shallow as the Mississippi River inland waterway system.

Figure 3:
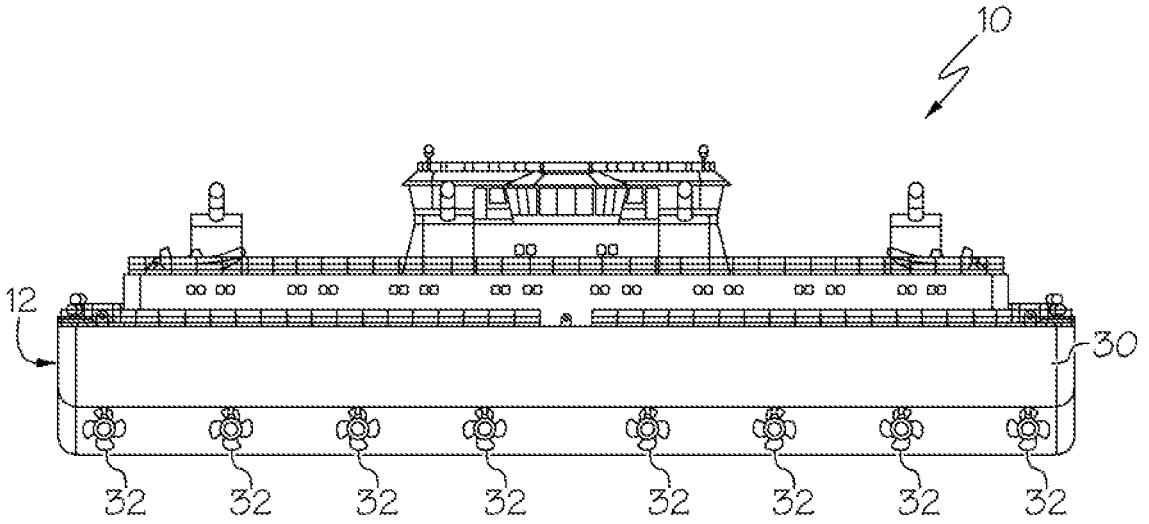
FIG. 3 is a rear view of the container carrier of FIG. 1.
Figure 4:
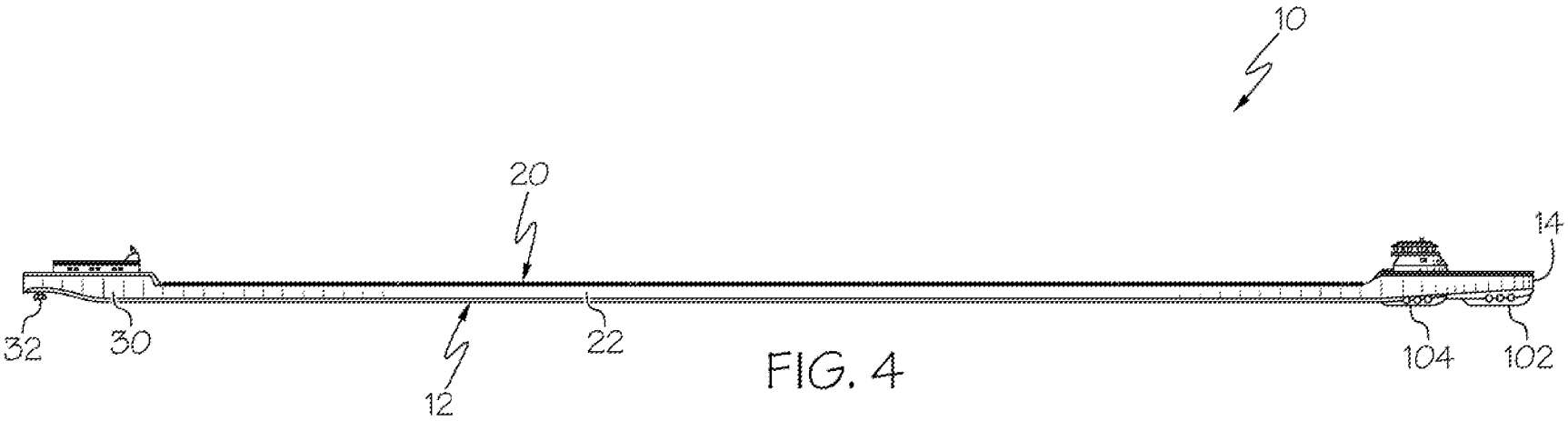
FIG. 4 is a view of a first side of the container carrier of FIG. 1.
Figure 5:
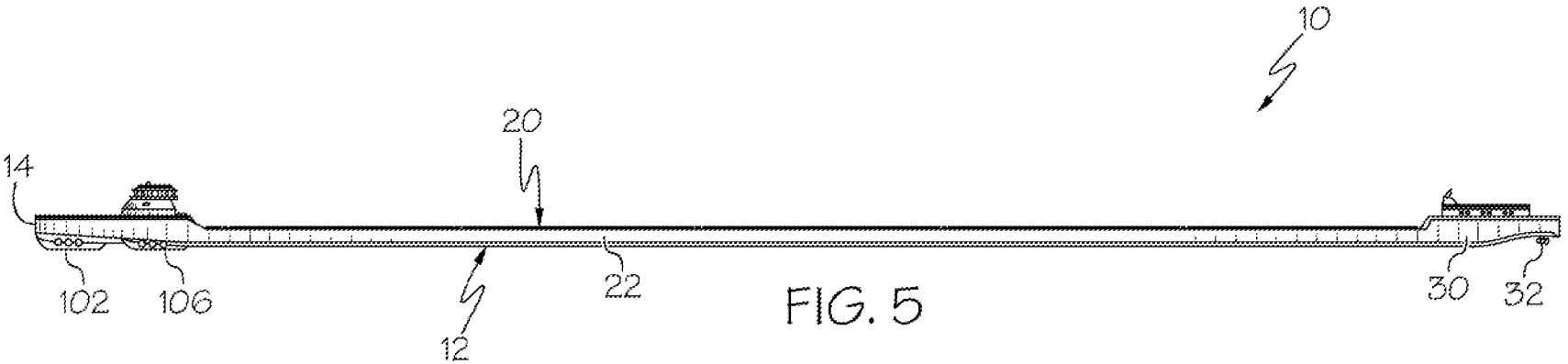
FIG. 5 is a view of a second side of the container carrier of FIG. 1.
Figure 6:
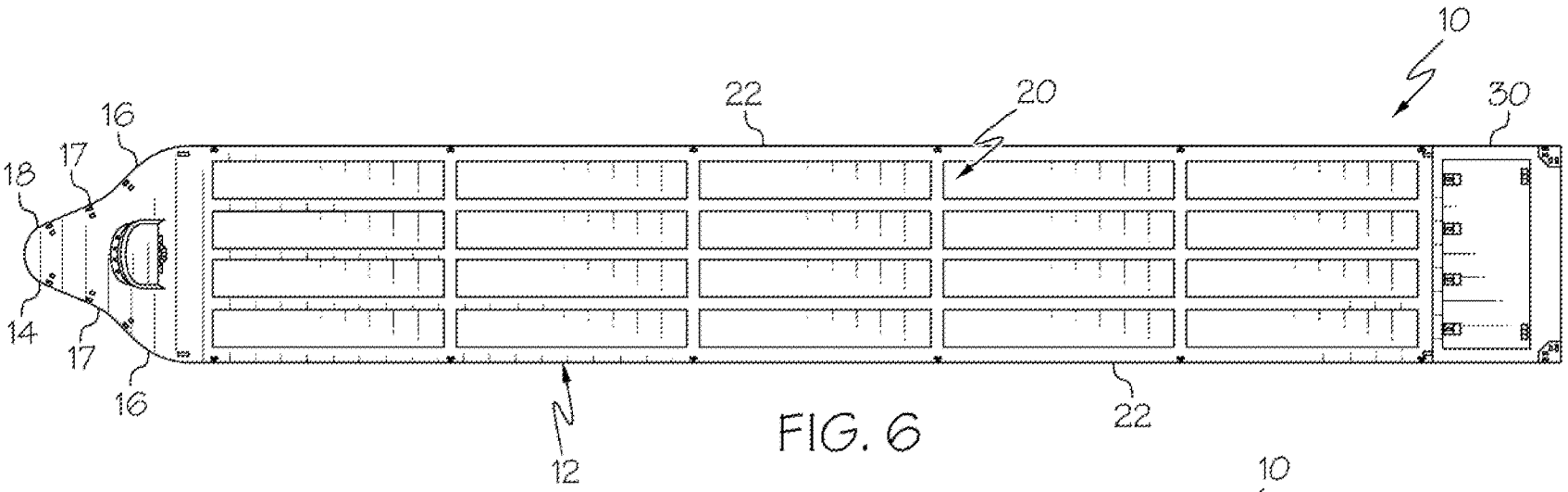
FIG. 6 is a top view of the container carrier; of FIG. 1.

The container carrier 10 may include a full beam stern 30. That is, the stern 30 of the container carrier, where the aft propulsion is housed, may have a width that is about equal to the midship beam of the container bay 20. As seen in FIG. 3, the stern 30 may be able to accommodate a plurality of thrusters 32. In the illustrated exemplary embodiment, eight thrusters 32 are utilized. In another embodiment, four thrusters 32 may be included. It is to be appreciated that by making the stern section of the container carrier 10 as wide as the midship or container bay beam, there is room along the stern 30 for a greater number of propellers. In other words, when compared to a conventional barge tow and push boat configuration, the container carrier 10 may be as wide as the tow, which means the container carrier 10 may be the same width as the configuration of individual barges of a conventional inland waterway transport tow. In one embodiment, the stern thrusters 32 may be nominally rated at 3500 HP each for a total of 14000 HP to 28000 HP at the stern, depending on the number of thrusters used. It is to be appreciated that the power of the thrusters 32 may depend on the traction motors, the prime generator capabilities, and the desired hull speed of the container carrier 10. The particular configuration and ratings of the stern propulsion system will depend on the configuration of the vessel container capacity, and the waterway that the vessel is built to operate on.

It is to be appreciated that the disclosed container carrier 10 may include a length over all (LOA) to beam aspect ratio of between 5:1 to 8:1. Preferably, the aspect ratio is about 7:1 (+/−10%), which may produce a relatively high hull speed, with low drag and good fuel efficiency. In the illustrated exemplary embodiment, the container carrier 10 includes the following dimensions: Bow: 200'×200'; Stern: 200'×200'; and Container Bay (external dimensions): 1100'×200'. In other embodiments, these exemplary dimensions may be scaled based upon length over all and/or beam. In the exemplary embodiment, the container carrier 10 has a displacement of about 100,000 dead weight tons, and may have a transit speed ranging from twelve to about eighteen knots while transporting up to twelve hundred 40 foot standardized containers, or 2400 TEU. For sake of comparison, a conventional tow may be as much as 1200 feet long by 200 feet wide, excluding the tow vessel itself, with a displacement of about 45,000 dead weight tons, with a transit speed of about 5-6 knots.

As further seen in FIGS. 1 and 7, the bow 14 may include a set of depending lateral thruster pods 100 (partially visible). In one embodiment, shown in FIG. 7, the set of depending lateral thruster pods 100 may include a first pod 102 disposed along the longitudinal centerline of the external hull, a second pod 104 disposed rearward of the first pod 102 and outward from the longitudinal centerline of the external hull, and a third pod 106 disposed rearward of the first pod 102 and outward from the longitudinal centerline of the external hull opposite from the second pod 104. In the illustrated embodiment, the first pod may be disposed proximate the ogive portion 18 of the bow 14, the second pod 104 may be disposed inboard of one side of the bow 14 proximate to where the rounded profile 16 intersects one lateral side 22 of the container bay 20, and the third pod 106 may be disposed inboard of the opposite side of the bow 14 proximate to where the rounded profile 16 intersects the opposite lateral side 22 of the container bay 20. For other bow profiles, such as a single radius ogive bow profile, the first pod 102 may be disposed proximate the fore-end of the keel, the second pod 104 may be disposed inboard of a first point where the bow has spread at least 85% of the container bay or midship beam, preferably at least 90% of the container bay or midship beam, and most preferably at least 95% of the container bay or midship beam, and the third pod 106 may be disposed inboard of the opposite side of the bow 14 proximate to a second point mirroring the first point. The depending lateral thruster pods define longitudinal flow channels therebetween, with the depending first 102 and second 104 pods defining a first longitudinal flow channel 110 to one side of the longitudinal centerline of the external hull 12 and the depending first 102 and third 106 pods defining a second longitudinal flow channel 112 to the opposite side of the longitudinal centerline of the external hull 12.

In the illustrated exemplary embodiment, three tunnel thrusters 120 are included in each lateral thruster pod 100, and may be nominally rated at 3500 HP each for a total of 31500 HP at the bow. In another exemplary embodiment, two tunnel thrusters 120 may be included. It is to be appreciated that the number and power of the tunnel thrusters will vary depending upon the displacement, water draft, and LOA-to-beam aspect ratio of the vessel, which relate to the resistance of the hull to transverse movement. The lateral thruster pods 100 may be elongated with respect to the longitudinal centerline of the vessel, such that the set forms a submerged, trimaran-like structure depending from the external hull 12. This submerged, trimaran-like structure advantageously reduces the wake of the vessel and tends to deflect debris into particular paths under the external hull, enabling some additional debris protection for the stern drives 32. In addition, the structure permits each lateral thruster pod 100 to be employed when executing a turning maneuver, including tunnel thrusters 120 in the pod 100 on the inside of the intended turn.

Figure 8A:
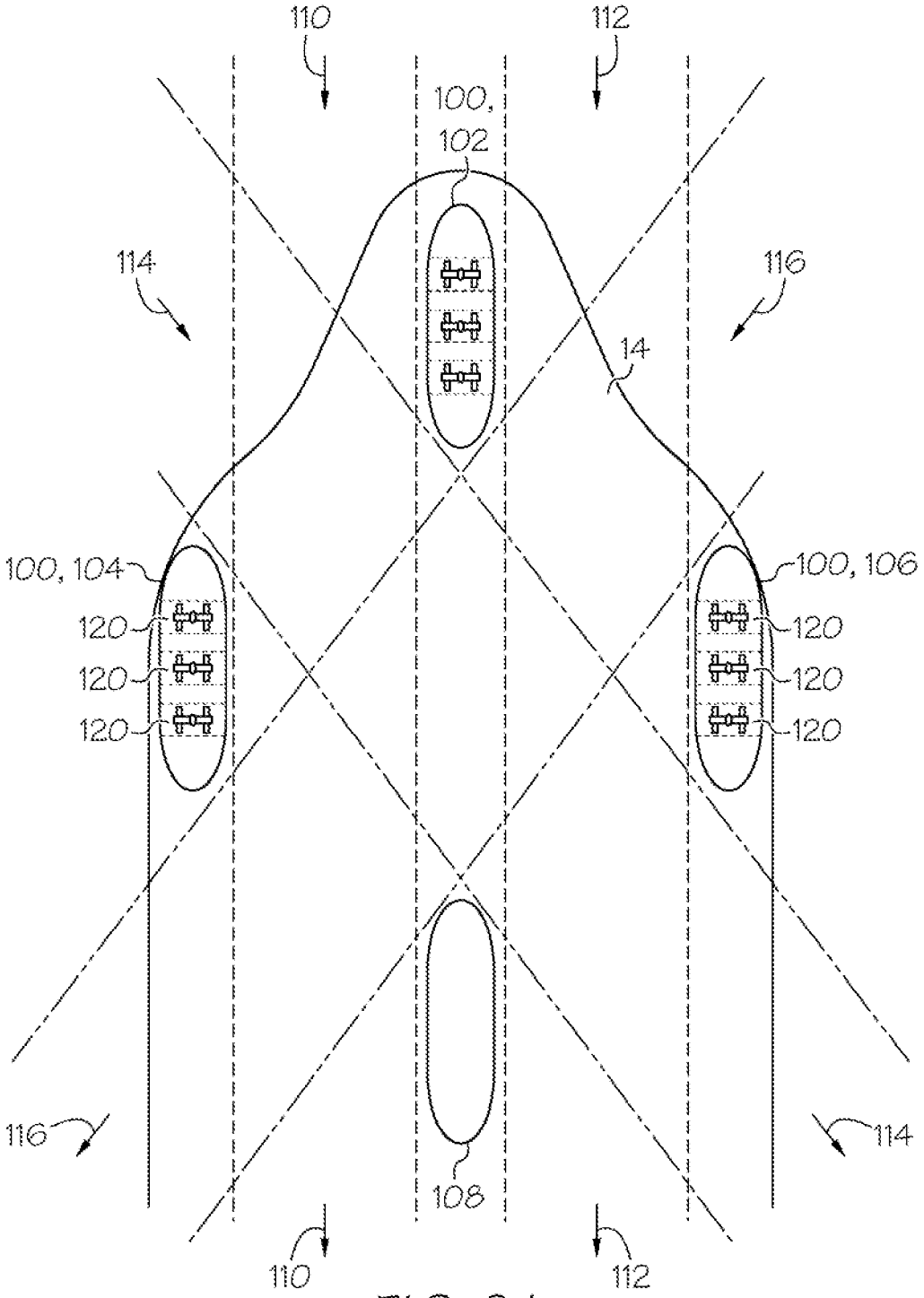
FIG. 8A is a schematic view of an exemplary configuration of the disclosed steering mechanism.
Figure 8B:
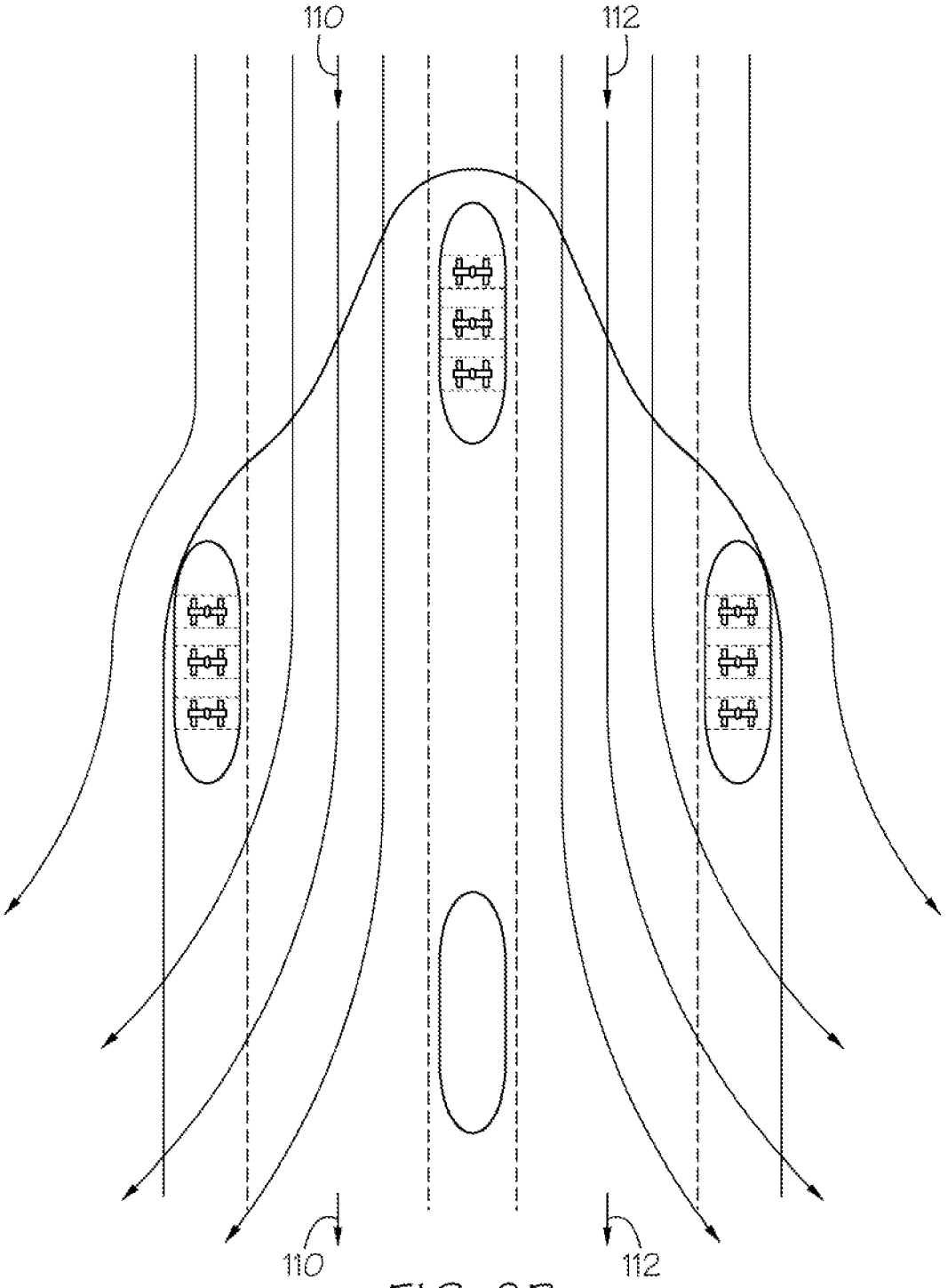
FIG. 8B is an illustration of flow through the disclosed steering mechanism during non-turning, forward movement.
Figure 8C:
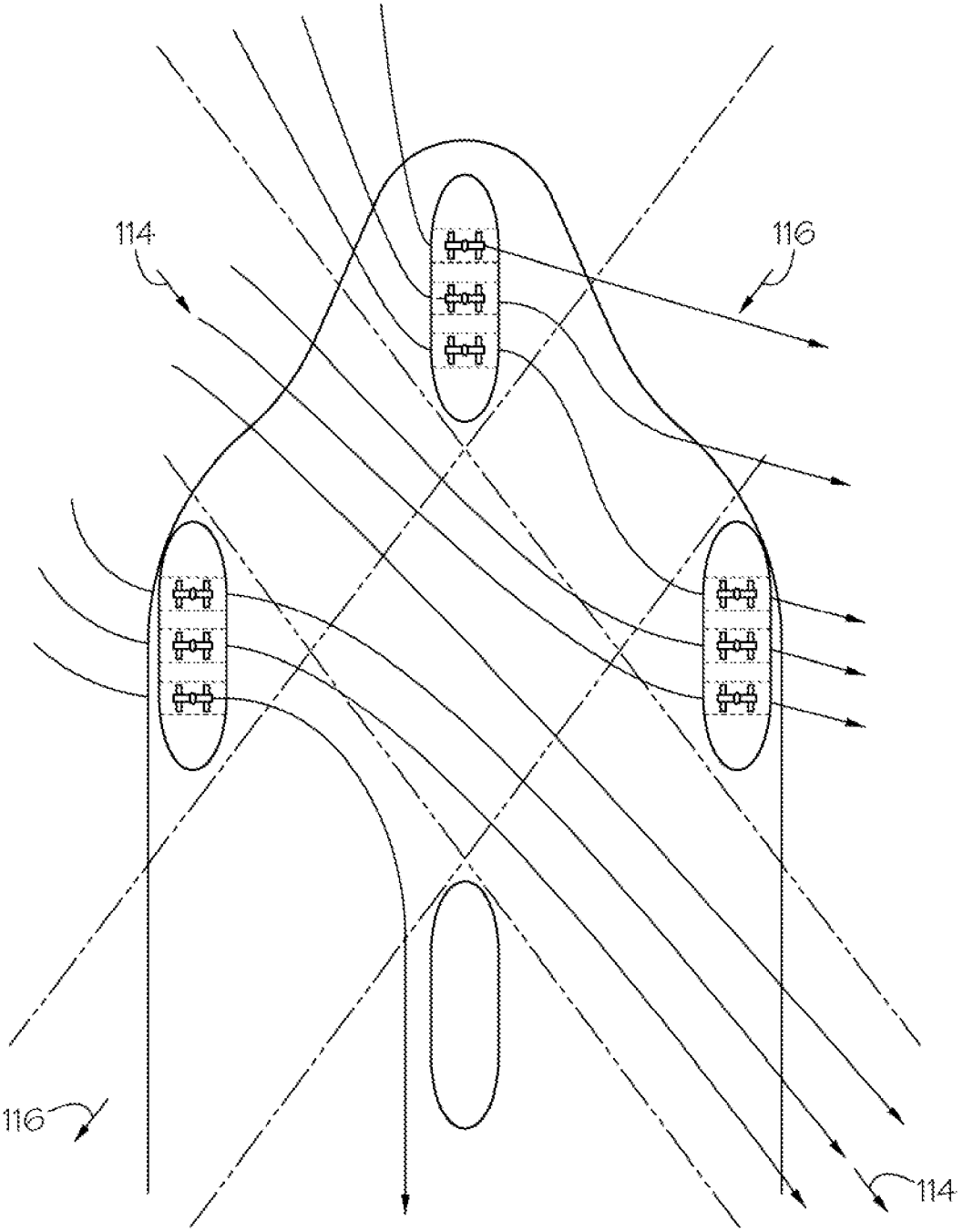
FIG. 8C is an illustration of flow through the disclosed steering mechanism during a turning maneuver.

As shown in FIG. 8A, the set of depending lateral thruster pods 100 may include a fourth pod 104 disposed along the longitudinal centerline of the external hull 12 reward of the first, second, and third thruster pods 102, 104, and 106. The fourth pod 104 may be an unpopulated pod lacking any tunnel thrusters and disposed to define, in combination with the first, second, and third pods 102, 104, and 106, a first cross-centerline flow channel 114 and a second cross-centerline flow channel 116, where the first and second cross-centerline flow channels intersect proximate the longitudinal centerline of the external hull 12. As illustrated in FIG. 8B, when the vessel is underway, with non-turning, forward movement, water tends to be directed into and through longitudinal flow channels 110 and 112 until diverted outward by the overall shape and displacement of the external hull 12, i.e., such outward diversion would occur without or without the presence of fourth pod 108. As illustrated in FIG. 8C, when a pod, e.g., pod 104, is positioned on an inside of an intended turn, and operated to eject water toward the longitudinal centerline of the external hull 12, the ejected water combined with water passing through the longitudinal flow channels 110 and 112 may be directed at least partially through the first cross-centerline flow channel 114 to the outside of the intended turn. Similarly, when the pod 106 is positioned on an inside of the intended turn, and operated to eject water toward the longitudinal centerline of the external hull 12, the ejected water combined with water passing through the longitudinal flow channels 110 and 112 may be directed at least partially through the second cross-centerline flow channel 116 to the outside of the intended turn. Operative control of the first, second, and third pods 102, 104, and 106, and optionally the stern thrusters 32 so as to alter the flows entering the first and second longitudinal channels 110 and 112, permit a form of lateral thrust vectoring within the set of depending lateral thruster pods 100. However, the pods 100 and collective set thereof are rigid structures depending from the external hull 12. It will be appreciated that outward diversion of the ejected water would still exist in the absence of the fourth pod 108—and may be sufficient in non-illustrated embodiments—but the presence of the fourth pod causes the flow to be directed in a more limited range of directions so as to enhance thrust vectoring performance.

The pods 100 comprise a multi-hull component of the bow 14 of the external hull 12. As such, the leading end of a pod 100 may be shaped and configured in a bow-like shape which attaches to or merges into the external hull 12. For example, in the embodiment shown in FIG. 8, the leading end of at least one of the pods 100 may include a single radius ogive profile attached to the double radius ogive profile external hull 12. In other embodiments, the leading end of a least one the pods may include a so-called "inverted bow shape" attached to the double radius ogive profiled or other-profiled external hull 12. The inverted bow shape may be employed to resist the accumulation of debris at the bow of the vessel, to assist in maintaining submersion the thruster pods below the water line, and to extend the wetted area of the hull. The leading ends of the pods 102, 104, 106, and 108 may include identical or different profiles. For example, the pod 102 may include an inverted bow shape while the pods 104 and 106 and the fourth pod 108 may include a non-inverted, single radius ogive profile. The profiles, materials, and material thicknesses of at least the leading ends of the pods, particularly the first pod 102, may be selected to form an ice-class structure so as to enable operation, e.g., in late autumn, winter, and/or early spring, depending upon local climate, and to resist damage from ice flows or non-ice debris.

In one embodiment the container carrier 10 may include four generator sets, seventeen electric drive motors (eight stern motors and nine bow tunnel thrusters), and two power transformers. One commercial example of the generators that may be used are the 12V50 Generator Sets (nominally 11000 Kilowatts each) available from the Wärtsilä Corporation of Finland. One commercial example of the electric drive motors that may be used is the Invertex 360T available from GE Transportation of Chicago, Illinois. The traction motors and electric drive motors used within the container carrier 10 may be originally intended for mining applications.

The double radius ogive bow 14 may allow for fine entry of the container carrier 10 in areas of limited space, for reduced drag, and for lateral thruster pods providing directional control, including a zero turn radius capability while the carrier is underway. Furthermore, the double radius ogive bow 14 may also enable the bow 14 to reach full beam rapidly, which in turn results in increased cargo space. It is to be appreciated that the combination of a double radius of the ogive bow 14 with pods 104, 106 disposed outward of the longitudinal centerline of the external hull 12 may substantially cancel primary bow wake. This would result in the container carrier 10 having a zero turning radius, and generating substantially no wake while operating at two to three times the speed of conventional legacy inland waterway transportation assets. Furthermore, this would also allow for the container carrier 10 to steer through a bend in a river without backing down the propellers of the stern 30, so as not to lose forward speed. Finally, the use of a distributed electric propulsion system in conjunction with a set of tunnel thrusters 120 in the bow 14, whether using a double radius ogive bow or other bow shape, may also substantially eliminate the need for the container carrier 10 to cycle the engines, which in turn may reduce fuel burn and engine wear.

Referring generally to the figures, the disclosed container carrier 10 may provide various technical effects and benefits. The disclosed container carrier 10 may include a lateral thruster pod and tunnel thruster configuration that may enhance speed, efficiency, maneuverability, and safety. Specifically, a lateral thruster pod configuration defining both longitudinal and intersecting, cross-centerline flow channels permits a form of lateral thrust vectoring through the various channels and useful utilization of each of the respective pods while executing turns to either side of the vessel. Furthermore, the combination of double radius ogive bow 14 with the lateral thruster pod configuration provides enhanced directional control by providing enhanced separation of laterally-spaced apart thruster pods and channeling surface water on the inside of a turn toward cross-centerline flow channel for reduced turning resistance.

While the forms of apparatus and methods herein described constitute preferred embodiments of this invention, it is to be understood that the invention is not limited to these precise forms of apparatus and methods, and the changes may be made therein without departing from the scope of the invention.

The invention claimed is:

1. A container carrier ship comprising an external hull including a bow, a stern, and a container bay having mutually opposing lateral sides extending between the bow and stern, the bow having a set of depending lateral thruster pods including:

a first pod disposed along a longitudinal centerline of the external hull;

a second pod disposed rearward of the first pod and outward from the longitudinal centerline of the external hull; and a third pod disposed rearward of the first pod and outward from the longitudinal centerline of the external hull opposite from the second pod;

wherein the first and second pods define a first longitudinal flow channel to one side of the longitudinal centerline of the external hull and the first and third pods define a second longitudinal flow channel to an opposite side of the longitudinal centerline of the external hull.

2. The container carrier ship of claim 1, wherein the external hull further comprises a fourth pod disposed along the longitudinal centerline of the external hull rearward of the first, second, and third pods, and wherein the fourth pod in combination with the first, second, and third pods defines a first cross-centerline flow channel and a second cross-centerline flow channel, with the first and second cross-centerline flow channels intersecting proximate the longitudinal centerline of the external hull.

3. The container carrier ship of claim 2, wherein the first, second, and third pods each include a plurality of tunnel thrusters, and the fourth pod is unpopulated by tunnel thrusters.

4. The container carrier ship of claim 2, wherein the first, second, third, and fourth pods each include a plurality of tunnel thrusters.

5. The container carrier ship of claim 1, wherein the bow comprises a double radius ogive profile having two sides that each include a rounded profile having a first radius, a tapered ogive portion having a second radius, and a recurved portion disposed proximate an intersection of the rounded profile with the tapered ogive portion to provide a smooth transition therebetween.

6. The container carrier ship of claim 5, where the first pod is disposed proximate the tapered ogive portion of the bow, the second pod is disposed inboard of one side of the bow proximate to where the rounded profile intersects one lateral side of the container bay, and the third pod is disposed inboard of an opposite side of the bow proximate to where the rounded profile intersects an opposite lateral side of the container bay.

7. The container carrier ship of claim 1, wherein the first pod is disposed proximate a fore-end of a keel of the bow, the second pod is disposed inboard of a first point where the bow has spread at least 85% of a beam of the container bay, and the third pod is disposed inboard of an opposite side of the bow and proximate to a second point mirroring the first point.

8. The container carrier ship of claim 1, wherein the first pod has a leading end, and the leading end includes an inverted bow shape.

9. The container carrier ship of claim 8, wherein the second and third pods have a leading end, and the leading end includes a non-inverted, single radius ogive profile.

* * * * *